US008827882B2

(12) United States Patent
Rogers

(10) Patent No.: US 8,827,882 B2
(45) Date of Patent: Sep. 9, 2014

(54) PROPRIOCEPTION BALANCE AND COORDINATION ENHANCEMENT SYSTEM

(76) Inventor: Chad Rogers, Tacoma, WA (US)

( * ) Notice: Subject to any disclaimer, the term of this patent is extended or adjusted under 35 U.S.C. 154(b) by 900 days.

(21) Appl. No.: 12/986,955

(22) Filed: Jan. 7, 2011

(65) Prior Publication Data

US 2012/0178599 A1 Jul. 12, 2012

(51) Int. Cl.
*A63B 22/14* (2006.01)

(52) U.S. Cl.
USPC ..... 482/146; 482/34; 482/147

(58) Field of Classification Search
USPC ..... 482/34, 51, 57, 79, 146, 147
See application file for complete search history.

(56) References Cited

U.S. PATENT DOCUMENTS

| | | | | |
|---|---|---|---|---|
| 3,511,500 | A * | 5/1970 | Dunn | 482/113 |
| 3,834,723 | A | 9/1974 | Erlebach | |
| 4,150,499 | A | 4/1979 | Wang | |
| 4,328,627 | A | 5/1982 | Sanders | |
| 4,605,220 | A * | 8/1986 | Troxel | 482/79 |
| 4,653,748 | A | 3/1987 | Seel et al. | |
| 4,759,542 | A * | 7/1988 | Hudec | 482/34 |
| 4,767,118 | A | 8/1988 | Ostergard | |
| 4,822,039 | A * | 4/1989 | Gonzales et al. | 482/146 |
| 5,284,460 | A * | 2/1994 | Miller et al. | 482/51 |
| 5,317,822 | A | 6/1994 | Johnson | |
| 5,328,421 | A * | 7/1994 | Stanalajczo | 482/34 |
| 5,518,476 | A | 5/1996 | McLeon | |
| 5,569,174 | A | 10/1996 | Varn | |
| 5,722,919 | A * | 3/1998 | Timmer | 482/79 |
| 5,735,805 | A | 4/1998 | Wasserman et al. | |
| 5,891,002 | A * | 4/1999 | Maki | 482/79 |
| 5,897,464 | A | 4/1999 | McLeod | |
| 6,692,419 | B2 | 2/2004 | Chen | |
| 6,705,977 | B1 * | 3/2004 | Ziak | 482/146 |
| 6,821,235 | B1 * | 11/2004 | Johnson et al. | 482/79 |
| 7,008,359 | B2 * | 3/2006 | Fan et al. | 482/146 |
| 7,252,290 | B1 * | 8/2007 | Kaselitz | 273/449 |
| 7,254,905 | B2 | 8/2007 | Dennison | |
| 7,322,914 | B1 | 1/2008 | Vittone et al. | |
| 7,621,861 | B1 | 11/2009 | Kalember et al. | |
| 7,775,952 | B1 | 8/2010 | Curran et al. | |
| 7,878,960 | B1 * | 2/2011 | Liu | 482/146 |
| 2008/0269026 | A1 | 10/2008 | Tsadok | |

FOREIGN PATENT DOCUMENTS

| | | | |
|---|---|---|---|
| GB | 191108139 | | 0/1911 |
| GB | 1372342 | | 4/1973 |
| JP | 8033735 | A | 2/1996 |
| JP | 2005312922 | | 11/2005 |
| KR | 100654883 | B1 | 9/2006 |
| KR | 100761036 | B1 | 10/2007 |
| WO | 2006094397 | A1 | 9/2006 |

* cited by examiner

*Primary Examiner* — Glenn Richman
(74) *Attorney, Agent, or Firm* — George A. Leone; Citadel Patent Law

(57) ABSTRACT

A system for enhancing proprioception, balance, and coordination includes a frame, at least one foot pad having an integrated central rail for mating with the frame, where the integrated track allows for the connection of a plurality of different interchangeable attachments which connect with the frame on a mating track. The plurality of different interchangeable attachments includes a plurality of fulcrums having different shapes acting to alter the level of difficulty to increase a patient's mobility and balance.

17 Claims, 9 Drawing Sheets

PROPRIOCEPTION BALANCE AND COORDINATION ENHANCEMENT SYSTEM

TECHNICAL FIELD

The present invention relates to a method and apparatus for enhancing proprioception balance and coordination. More particularly, the invention relates to a self storing kit consisting of multiple interchangeable range of motion elements enhancing proprioception, balance, and coordination.

BACKGROUND

There is an unfilled, long felt need in the art for a dual leg system for enhancing proprioception, balance, and coordination with flexibility for providing a wide range of exercises with a reduced set of equipment so as to lower costs and optimize storage room in crowded facilities. The present invention provides a novel solution to fill this long felt need.

Representative publications in the prior art addressing this area include the following:

U.S. Pat. No. 4,767,118, issued Aug. 30, 1988, discloses securing a foot to movement resisting member with rail mounted receiving channel in bottom of sole-piece.

U.S. Pat. No. 5,317,822, issued Jun. 7, 1994, discloses a footplate sole with interchangeable appliances secured through peripheral rail in slots, the rail in the bottom receiving different members.

International Publication No. WO 2006094397, published Sep. 14, 2006, discloses an apparatus for exercising foot/ankle muscles with a fore-foot component attached to resistance components and telescoping members.

U.S. Pat. No. 4,605,220, issued Aug. 12, 1986, discloses an ankle exerciser and rehabilitation device with the foot plate attached to support post by a telescoping adjustable universal joint.

U.S. Pat. No. 7,254,905, issued Aug. 14, 2007, discloses a longitudinal guiding portion extending longitudinally along length soleplate for longitudinal rail with T-sectioned channels.

U.S. Pat. No. 4,328,627, issued May 11, 1982, discloses metal mounting beam embedded insole with series of apertures to which attachments may be fixed to the channel in the bottom.

US Patent Publication No. 2008/0269026, published Oct. 30, 2008, discloses a base housing and footrest cover around actuating system, all configured to define axis of rotation of pivotal rocking motion with an adjustable footrest displacement.

U.S. Pat. No. 4,653,748, issued Mar. 31, 1987, discloses an exerciser with a flat platform to support standing user on a hemispherical member for tilting around re-locatable axis points.

U.S. Pat. No. 5,891,002, issued Apr. 6, 1999, discloses an exerciser for rehabilitation of the ankle after medical complications, with single and dual foot modes.

UK Patent No. GB 1372342, issued Oct. 30, 1974, discloses an ankle exercising apparatus universally tiltable platforms with control coil spring and pivot.

U.S. Pat. No. 3,834,723, issued Sep. 10, 1974, discloses attachments secured by permanent magnets.

U.S. Pat. No. 7,322,914, issued Jan. 29, 2008, discloses an ankle exercise device for rehabilitating injury with pivot assembly members connected to frames and tension members extending between frame and square, having a telescoping adjustable body contact part.

U.S. Pat. No. 7,775,952, issued Aug. 17, 2010, discloses a balance training apparatus sub-frame with a framed-in area of square-frame construction.

U.S. Pat. No. 5,518,476, issued May 21, 1996, discloses an ankle exercise device for exercising subtalar complex with controlled triplaner motion on a square, telescoping standing platform and handrail for a rotatable foot plate that is controllable and adjustable in three planes with fixed settings in all planes, including oblique.

U.S. Pat. No. 7,621,861, Nov. 24, 2009, discloses a rotational exercise apparatus with foot plates mounted on platform for rotating and counter rotating platform and plates constructed of square tubing.

BRIEF SUMMARY OF THE DISCLOSURE

A system and method for enhancing proprioception includes a frame, at least one foot pad having an integrated central rail for mating with the frame, where the integrated track allows for the connection of a plurality of different interchangeable attachments which connect with the frame on a mating track. The plurality of different interchangeable attachments includes a plurality of fulcrums having different shapes acting to alter the level of difficulty to increase a patient's proprioception, balance, and coordination.

BRIEF DESCRIPTION OF THE DRAWINGS

While the novel features of the invention are set forth with particularity in the appended claims, the invention, both as to organization and content, will be better understood and appreciated, along with other objects and features thereof, from the following detailed description taken in conjunction with the drawings, in which:

Figure 1:
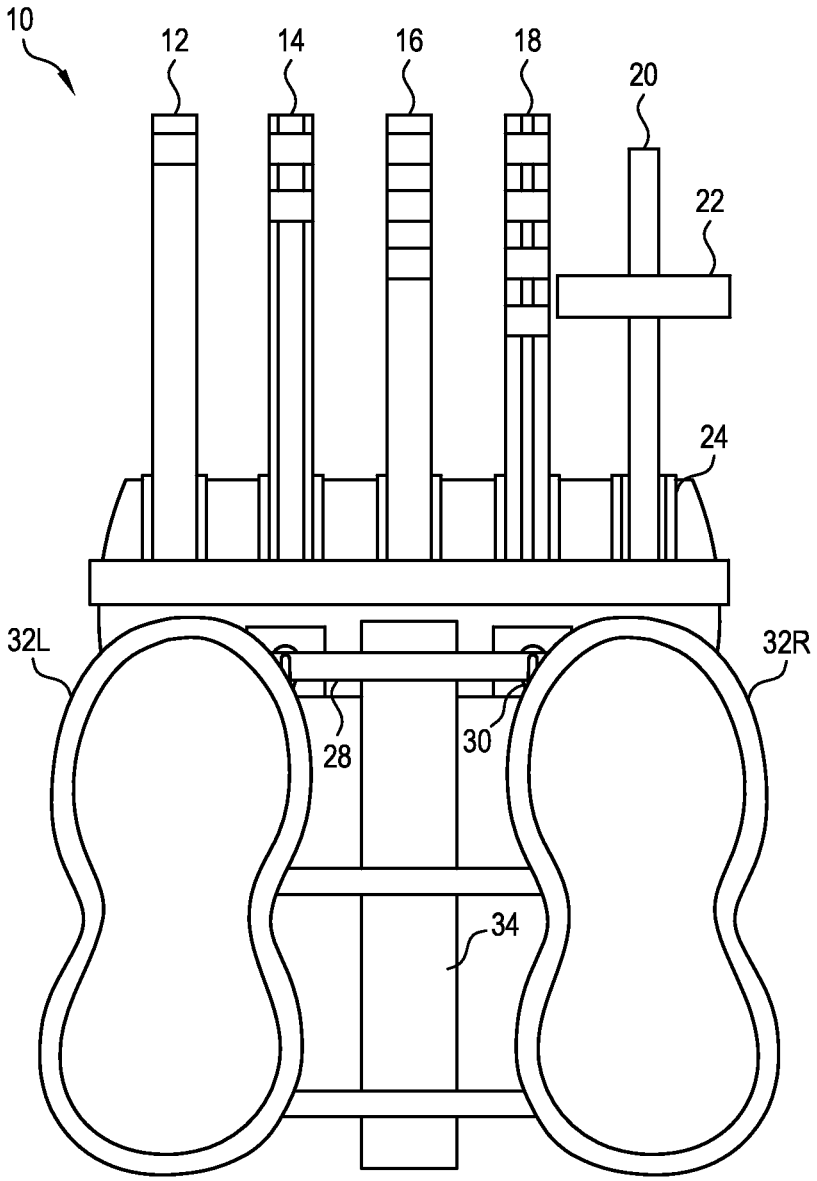
FIG. 1 schematically shows an example of a proprioception, balance, and coordination enhancement system stored in a self-storing storage rack preferably provided with the system.

In the drawings, identical reference numbers identify similar elements or components. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings.

DETAILED DESCRIPTION OF THE PREFERRED EMBODIMENTS

The following disclosure describes several embodiments, methods and systems for a system for enhancing proprioception, balance, and coordination. Several features of methods and systems in accordance with example embodiments are set forth and described in the Figures. It will be appreciated that methods and systems in accordance with other example embodiments can include additional procedures or features different than those shown in Figures. Example embodiments are described herein with respect to rehabilitation of human legs, ankles, and feet. However, it will be understood that these examples are for the purpose of illustrating the principles, and that the invention is not so limited.

Additionally, methods and systems in accordance with several example embodiments may not include all of the features shown in these Figures. Throughout the Figures, like reference numbers refer to similar or identical components or procedures.

Unless the context requires otherwise, throughout the specification and claims which follow, the word "comprise" and variations thereof, such as, "comprises" and "comprising" are to be construed in an open, inclusive sense that is as "including, but not limited to."

Reference throughout this specification to "one example" or "an example embodiment," "one embodiment," "an embodiment" or various combinations of these terms means that a particular feature, structure or characteristic described in connection with the embodiment is included in at least one embodiment of the present disclosure. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

Unless otherwise dictated by context, the term "proprioception" as used herein includes a person's sense of the relative position of parts of their body. Proprioception is a distinct sensory modality that provides feedback solely on the status of the body internally. It is the sense that indicates whether the body is moving with the required effort, as well as where the various parts of the body are located in relation to each other especially with respect to sensing balance and coordination.

Referring now to FIG. 1, an example of a proprioception, balance, and coordination enhancement system stored in a self-storage rack preferably provided with the system is schematically shown. One aspect of a proprioception, balance, and coordination enhancement system 10 is shown in its self-storage rack 26 where a plurality of enhancing proprioception balance and coordination components is mounted. In one embodiment the proprioception, balance, and coordination enhancement system 10 may be provided as a kit including the self-storage rack 26, a set of fulcrum attachments 12, 14, 16, 18, and 20, a frame 34 and a pair of foot pads 32R, 32L. The self-storage rack 26 may advantageously include mounting components suitably configured to mate with complementary mounting components located on the back of each of the set of fulcrum attachments 12, 14, 16, 18, and 20. The frame may advantageously comprise a plurality of support bars 28. At least one hanging element 30, as for example a pair of evenly spaced hooks or equivalent devices may advantageously be attached to the frame 34 for conveniently hanging the platform and footpads when not in use. In one embodiment the frame 34 comprises a double-leg platform for mounting the pair of foot pads 32R, 32L.

Figure 2C:
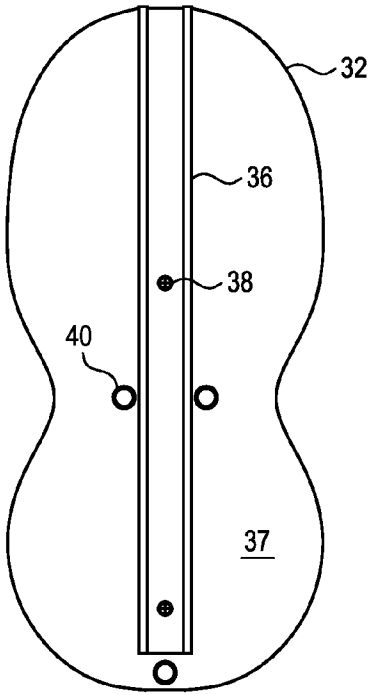
FIG. 2C schematically shows a bottom view of a foot pad featuring an integrated mounting element for use in one example of a system for enhancing proprioception.
Figure 2A:
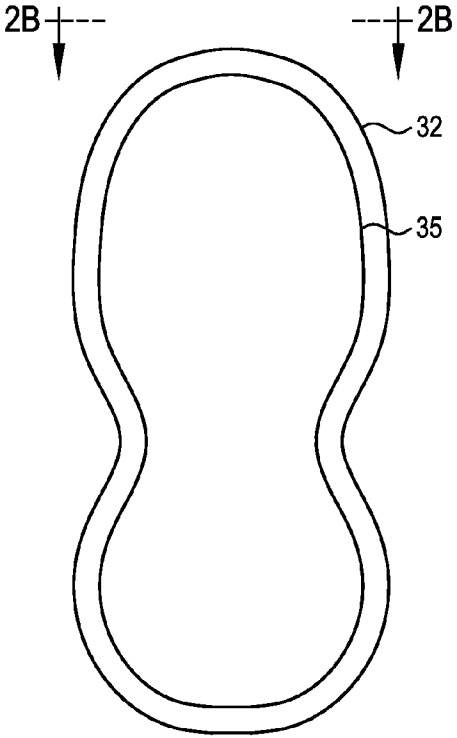
FIG. 2A schematically shows a top view of a foot pad for use in one example of a system for enhancing proprioception.

Referring now to FIG. 2A, a top view of a foot pad for use in one example of a system for enhancing proprioception, balance, and coordination is schematically shown. A foot pad 32 may generally be modeled after the shape of a human footprint, but large enough to accommodate a range of shoe or foot sizes. The foot pad 32 advantageously includes an inner top surface area covered with a non-slip surface 35. The non-slip surface may be any of a variety of commercially available non-slip or non-skid materials that can be glued or otherwise attached to the top surface of the foot pad 32. Alternatively, the non-slip surface can be molded directly into the footpad using, for example, a raised pattern, such as, for example, a crisscross pattern, or similar pattern, for traction.

Figure 2B:
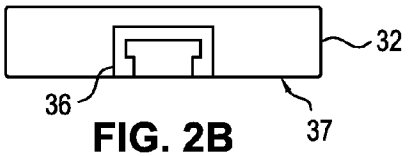
FIG. 2B schematically shows a front view of a foot pad featuring an integrated mounting element for use in one example of a system for enhancing proprioception.

Referring now to FIG. 2B, a front view of a foot pad featuring an integrated mounting element for use in one example of a system for enhancing proprioception, balance, and coordination is schematically shown. The footpad 32 may advantageously have a sufficient thickness to allow a mounting device 36, such as, for example a "T-track" insertion rail, to be integrated into the foot pad 32 substantially flush with the bottom surface 37 of the foot pad. The various elements of the system may be made using conventional manufacturing techniques as, for example, with molded plastic, nylon, or equivalent materials wherein features such as the rails and tracks are integrated with their respective components as a single molded piece. Other useful materials such as metal, including aluminum and wood may be employed as desired for individual parts.

Referring now to FIG. 2C, a bottom view of a foot pad featuring an integrated mounting element for use in one example of a system for enhancing proprioception, balance, and coordination is schematically shown. The integrated mounting element may advantageously be incorporated by molding it into the foot pad. In another example, the mounting device 36 may be integrated into the foot pad by means of a fastener 38 mounting it to the bottom of the foot pad 32. The fastener 38 may be any useful fastener such as a set of screws, adhesive, nails and the like. In one example embodiment, holding mechanism 40 such as, for example, a set of permanent magnets or the like may be incorporated onto the bottom surface for added stability and to prevent slippage of the foot pad when fastened to the frame.

Figure 3A:
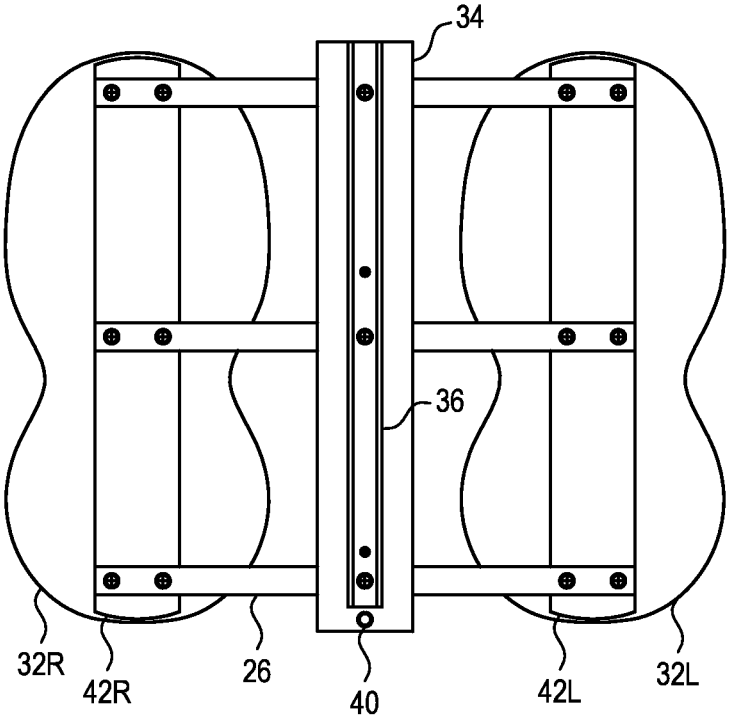
FIG. 3A schematically shows a bottom view of a foot pad as mounted on a double-leg platform as employed in one embodiment.

Referring now to FIG. 3A, a bottom view of the foot pads as mounted on a double-leg platform as employed in one embodiment is schematically shown. The frame 34 comprises double-leg platform for mounting the pair of foot pads 32R, 32L mounted to right and left elongated support elements 42L, 42R attached in parallel to an elongated central support element 41.

Figure 3B:
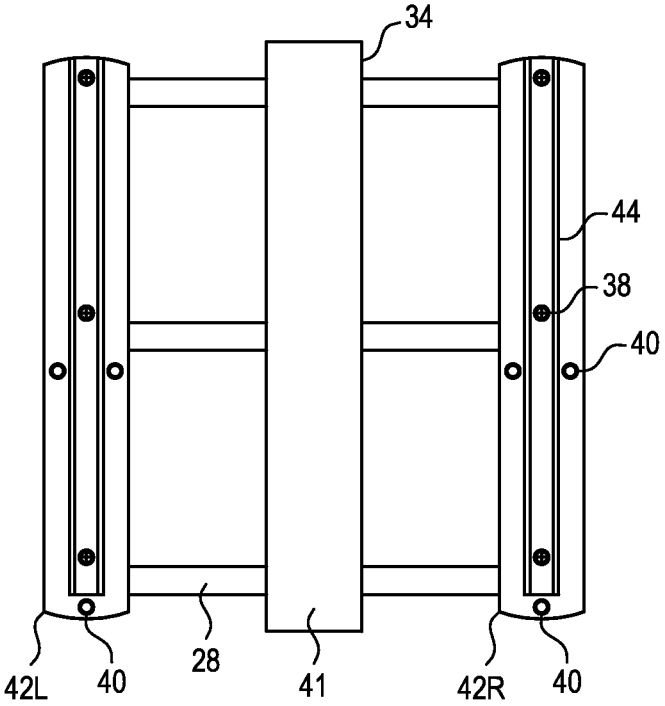
FIG. 3B schematically shows a top view of a double-leg platform as employed in one embodiment.

Referring now to FIG. 3B, a top view of a double-leg platform as employed in one embodiment is schematically shown. As described above, the frame 34 comprises double-leg platform for mounting the pair of foot pads 32R, 32L. The frame 34 further comprises right and left elongated support elements 42L, 42R attached to an elongated central support element 41 by at least two or, more preferably, three support bars 28. The right and left elongated support elements 42L, 42R are oriented substantially parallel to the elongated central support element 41. Each of the plurality of support bars 28 is attached to substantially form a right angle with the elongated support elements. The support bars 28 may advantageously comprise aluminum tubing or the like for added strength. The support bars may also comprise telescoping parts as described below.

Each of the right and left elongated support elements 42L, 42R have a mounting device 44 for accepting and attaching the foot pads. The central support 41 also includes a similar mounting device 36 for mounting one of the set of fulcrum attachments. The selection of the fulcrum attachment depends on the type of exercise prescribed for the subject or patient. In one example embodiment, a plurality of permanent magnets 40 are distributed on the frame in a pattern that matches the location of opposite-polarity permanent magnets on the attachments and foot pads to hold the attachments and foot pads in place.

Figure 4A:
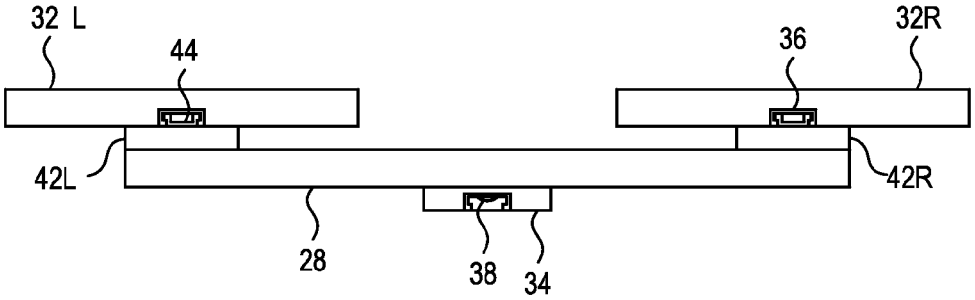
FIG. 4A schematically shows the side of a double-leg platform as employed in one embodiment.

Referring now to FIG. 4A, a schematic view of a double-leg platform as employed in one embodiment is schematically shown. For double leg balance two foot pads are attached, via the integrated central track, to a double leg platform. The double leg platform acts to position the balancing fulcrum in the center of the two attached foot pads. In one mode of operation the foot pads 32L, 32R are shown mounted to a double-leg platform frame 34. The foot pads may easily be attached and removed to the frame by sliding the track mechanism on the foot pads into the matching channels on the frame supports. Adding a fulcrum attachment is accomplished in the same manner by sliding a selected fulcrum attachment into the mounting device channel 36.

Figure 4B:
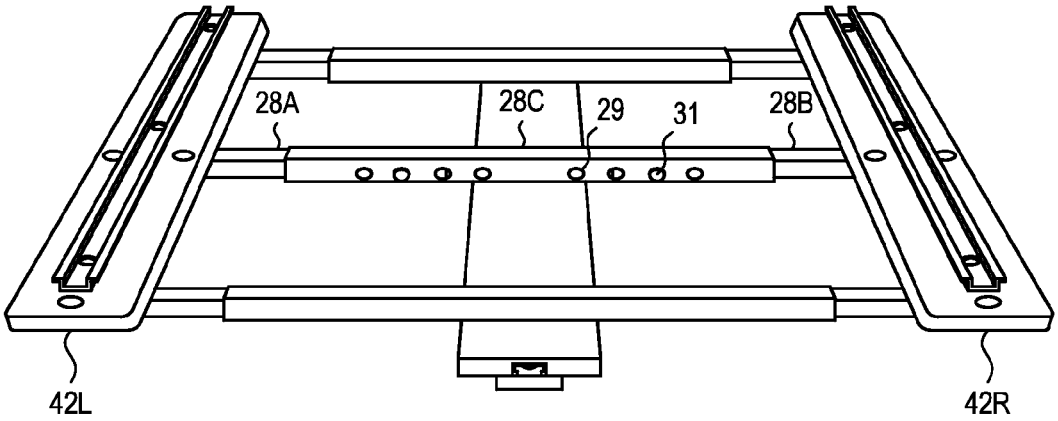
FIG. 4B schematically shows a side view of a telescoping support assembly for an adjustable double-leg platform as employed in one embodiment.

Referring now to FIG. 4B, a telescoping support for an adjustable double-leg platform as employed in one embodiment is schematically shown. In one embodiment the support bars 28 may advantageously comprise square telescoping tubing allowing adjustment of the distance between the foot pads. The telescoping tubing may comprise, for example, a telescoping assembly including a left member 28A, a central holding member 28C and a right member 28B. The telescoping members may included spring locks 31 that fit into a plurality of holes 29 arranged for different lengths. Such locking mechanisms are known in the art. A plurality of telescoping assemblies may be used in parallel as needed for support. The ends of the telescoping members are attached as above to the elongated support elements 42R, 42L. This feature allows adjusting the width of the stance as well as determining where the fulcrum is located relative to the foot pads. A therapist with a patient who is just starting to be weight bearing on an injured leg may want the center balance to be located closer to the patient's good leg as opposed to the injured leg.

Figure 5:
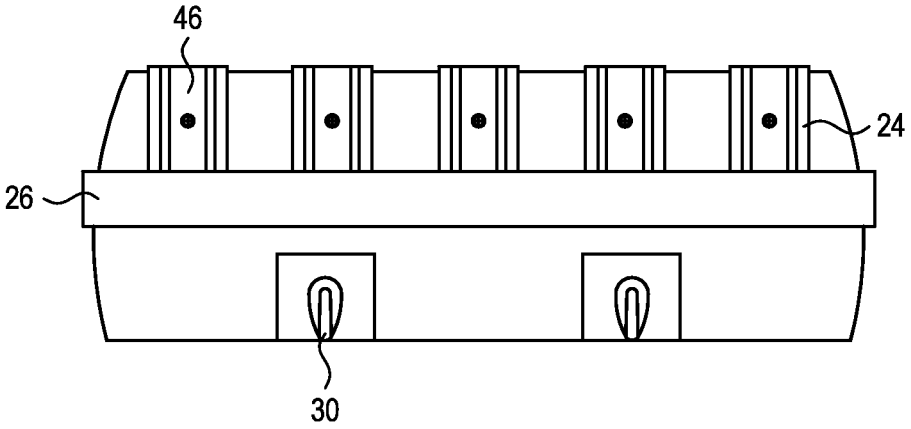
FIG. 5 schematically shows an example of a storage rack as employed in one embodiment.

Referring now to FIG. 5, an example of a storage rack as employed in one embodiment is schematically shown. The storage rack 26 includes a plurality of preferably modified mounting device channels 24 for holding the set of fulcrum attachments. The mounting device channels may be attached by conventional fasteners 46 or integrated within a back panel of the storage rack. Shown in more detail here is the set of hanging element 30, as for example a pair of evenly spaced hooks or equivalent devices may advantageously be attached to the frame 34 for conveniently hanging the platform and footpads when not in use.

Figure 6A:
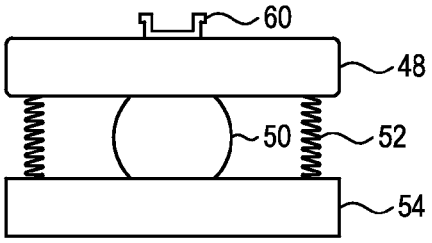
FIG. 6A schematically shows a front view of another interchangeable attachment including a compression spring attachment with interchangeable springs and including a unidirectional stability ball as employed in one embodiment of the system.

Referring now to FIG. 6A, an alternate embodiment compression spring attachment with interchangeable springs and including a unidirectional stability ball as employed in one embodiment of the system is schematically shown. The compression spring attachment provides resistance to assist in strengthen specific areas of the ankle and lower extremities. This attachment is intended to be used in place of a fulcrum attachment and may be mounted to the frame or a foot pad by a mounting "T-track" 60 or the like as described herein. A top plate 48 supports the frame or foot pad. A unidirectional stability ball 50, as is known in the art, is centered between the top plate 48 and a bottom plate 54. The top and bottom plates are each partially hollowed in a rounded fashion in order to hold the ball in a central location between them. Springs 52 are attached between the top plate and the bottom plate to provide resistance and to hold the two plates together while in use. In one embodiment the springs may be fastened with removable fasteners, such as twist off fasteners, in order to allow the use of springs of varying resistance strengths.

Figure 6B:
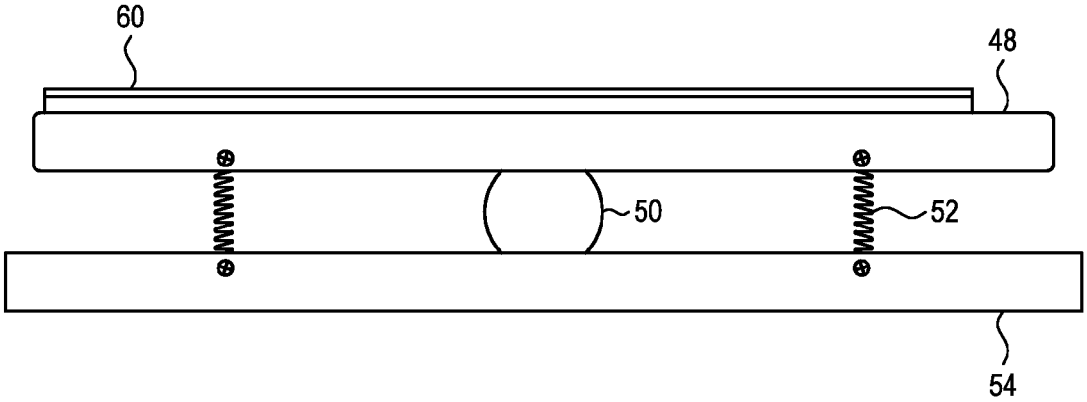
FIG. 6B schematically shows a side view of an alternate embodiment single platform compression spring attachment with interchangeable springs and including a unidirectional stability ball as employed in one embodiment of the system.

Referring now to FIG. 6B, an alternate embodiment single platform compression spring attachment with interchangeable springs and including a unidirectional stability ball as employed in one embodiment of the system is schematically shown. In one embodiment the springs 52 may be fastened with removable fasteners, such as, for example, durable screws 53 in a metal insert, twist off fasteners or the like, in order to allow interchanging springs of varying resistance strengths as desired.

Figure 7:
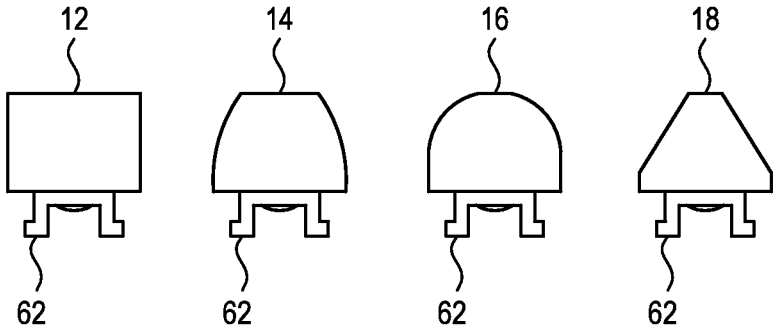
FIG. 7 schematically shows a a set of fulcrum attachments for use in example embodiments.

Referring now to FIG. 7, a set of fulcrum attachments for use in example embodiments is schematically shown. With a variety of attachments the system is able to be utilized at the skill level of the patient. As patients progress, and their skill level increases, the attachments can be changed to allow increased challenge to further aid skill development and patient progression. Under the supervision of a therapist or in a physical therapy setting the various attachments may be used for circumduction, plantar and dorsey flexion, eversion and inversion, and other therapy methods using different leg width positions to vary the level of difficulty.

Attachment 12 is generally rectangular in cross-section and may be used, for example, in the early stages of ankle rehabilitation. Attachment 14 is generally a trapezoidal shape and may have a smaller flat surface than attachment 12. Attachment 14 may be used for a patient in a more advanced stage of rehabilitation. Attachment 16 is a semi-oval shape and may be used in still further advanced stages of rehabilitation. Attachment 18 is substantially triangular in shape for use with patients having very improved mobility and balance skills. As shown in FIG. 1, one fulcrum attachment 22 includes a rounded cross beam for imparting a rocking motion to one or both ankles depending on whether it is mounted to a single foot pad or a double foot platform.

The set of fulcrum attachments 12, 14, 16, and 18 feature "T-track" mounting elements 62 for mounting to either a foot pad for single leg use or a double leg platform center support for double leg use.

Figure 8A:
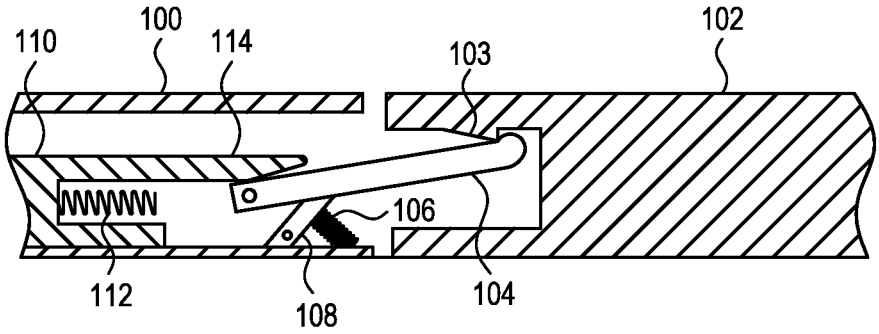
FIG. 8A schematically shows a cut-away side view of an alternate locking mechanism.

Referring now to FIG. 8A, a cut-away side view of an alternate holding mechanism is schematically shown. Here the mounting channel in the support bars or other selected mounting elements are replaced by a locking channel 102 having a catch 103. The locking channel is slightly receded so as to allow the insertion of a push-button lock located on a fulcrum attachment or foot pad as the case may be. The locking mechanism includes a push button 110, a resistance spring 112 that applies an outward force to the push button 110. An arm 112 bears on a catch 104 which is biased by spring 106 and held by pivot arm 108.

Figure 8B:
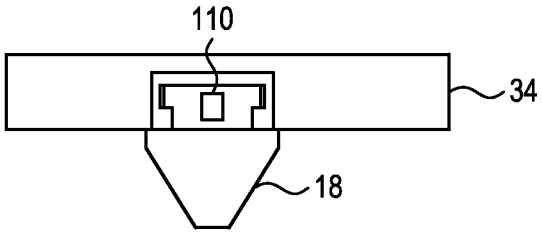
FIG. 8B schematically shows the locking mechanism mounted in place of a portion of the T-track.

Referring now to FIG. 8B the locking mechanism is further described. Here a fulcrum attachment 18 is shown with the locking mechanism mounted in place of a portion of the T-track.

Figure 9:
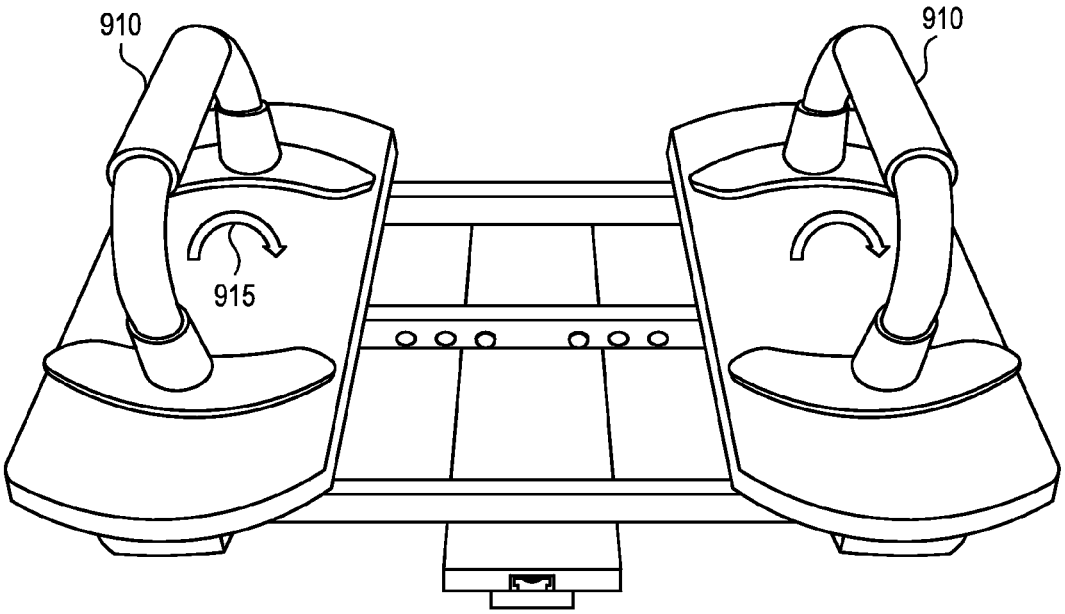
FIG. 9 schematically shows a push-up handle attachment with integrated rail to attach to platform frame.

Referring now to FIG. 9 a set of push-up handle attachments with integrated rail to attach to platform frame is shown. In one example the set of push-up handle attachments 910 may advantageously be made with a swivel mount indicated by arrows 912 that allow the handle to swivel 90 degrees or more to target different muscle groups. In another example, the push-up handle attachments 910 may be constructed to be rigidly mounted in any desirable orientation without the swivel mount. The swivel feature will allow the user to target different muscles groups, i.e. triceps vs. chest.

Having described the various features in this disclosure, it is now considered helpful to the understanding of this disclosure to explain the operation of at least one aspect of an example embodiment. In one aspect one, the pair of foot pads are mounted to the double-leg platform 34 and a fulcrum attachment is selected and mounted and locked in place to the central support element 41. A patient or other human subject may then stand on the foot pads to perform motion exercises. This should be done with the guidance of a professional therapist.

In another example, a fulcrum attachment is selected and mounted and locked in place to a single foot pad. A patient or other human subject may then stand on the foot pad to perform motion exercises using one leg. This should also be done with the guidance of a professional therapist.

The invention has been described herein in considerable detail in order to comply with the Patent Statutes and to provide those skilled in the art with the information needed to apply the novel principles of the present invention, and to construct and use such exemplary and specialized components as are required. However, it is to be understood that the invention may be carried out by specifically different equipment, and devices, and that various modifications, both as to the equipment details and operating procedures, may be accomplished without departing from the true spirit and scope of the present invention.

What is claimed is:

1. A system for enhancing proprioception, balance and coordination comprising:

a frame including an elongated central support element;

right and left elongated support elements attached to the elongated central support element by a plurality of support bars, where the right and left elongated support elements are oriented substantially parallel to the elongated central support element, and the plurality of support bars are attached substantially perpendicular to the elongated support elements;

wherein each of the elongated support elements includes a foot pad mounting element affixed thereto;

a pair of foot pads, each foot pad having an integrated central rail mated with one of the foot pad mounting elements;

where the elongated central support element includes a central mounting element that allows for the connection of a plurality of different fulcrum attachments each having central mating elements which connect with the central mounting element; and where each of the plurality of different interchangeable attachments includes one of a plurality of fulcrums, where each of the plurality of fulcrums has a different shape than the others so as to alter a level of difficulty when the different fulcrum shapes are used by a patient.

2. The system of claim 1 wherein the elements are provided in a kit.

3. The system of claim 2 wherein the kit further comprises: a self-storage rack for mounting the plurality of different interchangeable attachments, the frame and at least one foot pad.

4. The system of claim 1 wherein each foot pad comprises a foot pad substantially having the shape of a human footprint large enough to accommodate a range of shoe or foot sizes.

5. The system of claim 1 wherein each foot pad has an inner top surface area covered with a non-slip surface or molded non-slip pattern.

6. The system of claim 1 wherein the central mounting element comprises a T-track insertion channel.

7. The system of claim 1 wherein each foot pad includes set of holding elements matched to a set of frame holding elements for added stability when attached to a frame.

8. The system of claim 7 wherein the foot pad set of holding elements and frame holding elements include mating elements of a push-button locking mechanism.

9. The system of claim 7 wherein the frame comprises an adjustable double-leg platform.

10. The system of claim 9 wherein the plurality of support bars consists essentially of square telescopic tubing allowing adjustment of the distance between the foot pads.

11. The system of claim 1 where the plurality of different interchangeable attachments comprise attachments selected from the group consisting of a circumduction attachment, a plantar and dorsey flexion attachment, an eversion and inversion attachment, an attachment with a rectangular cross-section, an attachment with a trapezoidal cross section, an attachment with a semi-oval cross section, an attachment with a triangular cross section an attachment including a rounded cross beam, a set of push-up handle attachments, a set of push-up handle attachments on a swivel mount, and a compression spring attachment with a unidirectional stability ball.

12. The system of claim 11 wherein the compression spring attachment comprises a unidirectional stability ball adapted to be mounted to the frame or a foot pad.

13. The system of claim 12 wherein the compression spring attachment comprises:

a top plate for supporting the frame or foot pad and a bottom plate;

a unidirectional stability ball held between the top plate and the bottom plate;

a plurality of springs attached between the top plate and the bottom plate to provide resistance and to hold the two plates together while in use.

14. The system of claim 13 where the plurality of springs is fastened with removable fasteners to allow the use of springs of varying resistance strengths.

15. A system for enhancing proprioception, balance and coordination comprising:

an adjustable double-leg platform with an elongated central support element;

right and left elongated support elements attached to the elongated central support element by a plurality of adjustable support bars, where the right and left elongated support elements are oriented substantially parallel to the elongated central support element, and the plurality of adjustable support bars are attached substantially perpendicular to the elongated support elements;

wherein each of the elongated support elements includes a foot pad mounting element affixed thereto;

a pair of foot pads, each foot pad having a foot pad mating element for attachment to one of the foot pad mounting elements;

where the elongated central support element includes a central mounting element that allows for the connection of a plurality of different fulcrum attachments each having central mating elements which connect with the central mounting element; and where each of the plurality of different fulcrum attachments includes one of a plurality of fulcrums on the bottom, where each of the plurality of fulcrums has a different shape than the others so as to alter a level of difficulty when the different fulcrum shapes are used by a patient.

16. The system of claim 15 wherein the plurality of adjustable support bars comprise square telescopic tubing.

17. A foot pad for enhancing proprioception, balance and coordination comprising:

a foot pad base having a first mating element affixed thereto;

where the first mating element allows for the connection of a plurality of different interchangeable attachments having second mating elements which connect with the first mating element; and where each of the plurality of different interchangeable attachments includes one of a plurality of fulcrums on the bottom, where each of the plurality of fulcrums has a different shape than the others so as to alter a level of difficulty when the different fulcrum shapes are used by a patient.

* * * * *